US008720363B2

(12) United States Patent
Weatherford

(10) Patent No.: US 8,720,363 B2
(45) Date of Patent: May 13, 2014

(54) WATER ACTIVATED BUOYANCY DEVICE

(76) Inventor: Ian Weatherford, Evansville, IN (US)

( * ) Notice: Subject to any disclaimer, the term of this patent is extended or adjusted under 35 U.S.C. 154(b) by 344 days.

(21) Appl. No.: 13/345,171

(22) Filed: Jan. 6, 2012

(65) Prior Publication Data

US 2012/0174854 A1 Jul. 12, 2012

Related U.S. Application Data

(60) Provisional application No. 61/460,674, filed on Jan. 6, 2011.

(51) Int. Cl.
*B63B 22/10* (2006.01)
*B63C 7/26* (2006.01)

(52) U.S. Cl.
USPC ..... 116/209; 441/8

(58) Field of Classification Search
CPC ..... B63B 22/08; B63B 22/10; B63C 7/26
USPC ..... 116/107, 200, 209, 210, DIG. 7; 441/8, 441/95
See application file for complete search history.

(56) References Cited

U.S. PATENT DOCUMENTS 2,588,637 A * 3/1952 Krantz ..... 441/8
2,723,404 A * 11/1955 Krantz ..... 441/8
2,791,785 A * 5/1957 Metts ..... 441/8
3,049,733 A * 8/1962 Mennenga ..... 441/8
3,366,983 A * 2/1968 Adams ..... 441/8
3,934,865 A * 1/1976 Wedrall ..... 267/114
3,982,294 A * 9/1976 Hicken ..... 441/8
4,713,031 A * 12/1987 Fuller ..... 441/8
5,156,562 A * 10/1992 Pearson et al. ..... 441/8
8,127,707 B2 * 3/2012 Birkin ..... 116/210
2010/0205844 A1 * 8/2010 Williams ..... 42/1.01
2013/0047912 A1 * 2/2013 Bell ..... 116/209

* cited by examiner

*Primary Examiner* — R. A. Smith
(74) *Attorney, Agent, or Firm* — Gary K. Price

(57) ABSTRACT

A water activated device having a lower casing with a cavity into which a spring is received, followed by a plunger and a bobbin. The lower casing attaches to an upper casing which houses a floatation member and includes a central aperture sized to allow the plunger to pass. The bobbin is sandwiched between the floatation member and the plunger. The floatation member defines a line holding dispensing spool such that one end of a line is attached to the spool and the opposite end of the line is attached to the device. The bobbin is the water sensitive trigger: when the water comes in contact with the bobbin, the bobbin starts to disintegrate losing its structural integrity, allowing force to enable the spring, forcing the plunger against the floatation member which discharges the floatation member from the upper casing. Once the floatation member is discharged, the floatation member floats to the water surface.

15 Claims, 3 Drawing Sheets

WATER ACTIVATED BUOYANCY DEVICE

CROSS REFERENCES TO RELATED APPLICATIONS

U.S. Provisional Application for Patent No. 61/460,674, filed Jan. 6, 2011, with title "Water Activated Buoyancy Device" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The invention relates generally to a water activated device which includes buoyancy, and more specifically to a buoyancy device to assist in retrieving objects with negative buoyancy in water.

2. Brief Description of Prior Art

There has existed a long-felt need for a device which allows a user, such as a sportsman, to retrieve a negatively buoyant object, such as a firearm or bow, should that negatively buoyant object fall over the side of a boat for example, and sink in the water. Further needed is such a device that is small, inexpensive and lightweight so as not to effect the sportsman's application and use of the negatively buoyant object.

As will be seen from the subsequent description, the preferred embodiments of the present invention overcome shortcomings of the prior art.

SUMMARY OF THE INVENTION

Briefly stated, the present invention is directed to a water activated device which allows a user, such as a sportsman, to retrieve a negatively buoyant object, such as a firearm or bow, should that negatively buoyant object fall over the side of a boat for example. The water activated device generally includes a lower casing with a cavity into which a spring is received, followed by a plunger and a bobbin. The lower casing attaches to an upper casing which houses a floatation member and includes a central aperture sized to allow the plunger to pass. The bobbin is sandwiched between the floatation member and the plunger. The floatation member further defines a line holding dispensing spool such that one end of the line is attached to and wound about the spool and the opposite end of the line is attached to the device.

The water activated device is appropriately attached to the negatively buoyant object. The bobbin is the water sensitive trigger: when the water comes in contact with the bobbin, the bobbin starts to disintegrate losing its structural integrity, forcing the plunger against the floatation member which discharges the floatation member from the upper casing. Once the floatation member is discharged, the floatation member floats to the water surface.

DESCRIPTION OF THE PREFERRED EMBODIMENT

In accordance with the present invention, a water activated buoyancy device is disclosed. From the outset it should be understood that while the discussion herein may primarily illustrate the present invention as being used by a sportsman, to retrieve a negatively buoyant object, such as a firearm or bow, the water activated device of the present invention can also be used with any number of objects that are negatively buoyant and wish to be retrieved if dropped in the water.

The invention relates to a device that facilitates a user the ability to retrieve objects that if unsecured, can easily be lost over the side of a boat, sinking to an uncertain depth. In the broadest context, the water activated device of the present invention consists of components configured and correlated with respect to each other so as to attain the desired objective.

Figure 1:
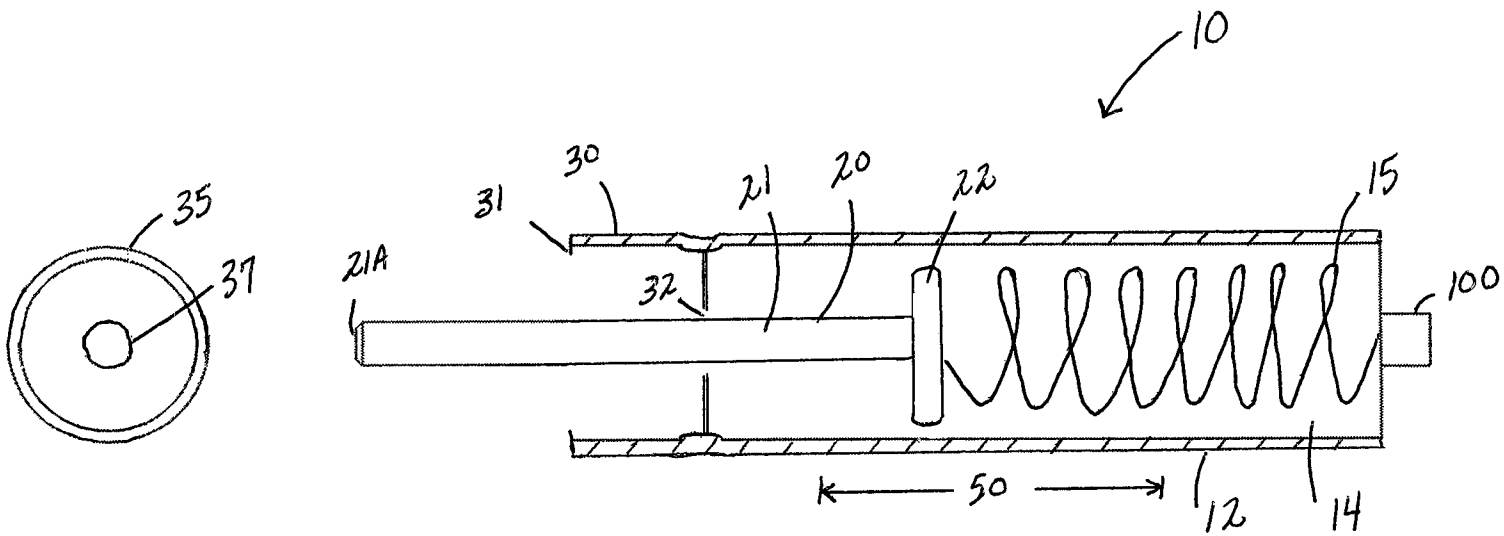
FIG. 1 is a side, sectional view of a preferred embodiment of the present invention, a water activated buoyancy device, where the tension mechanism is in a relaxed state.
Figure 3:
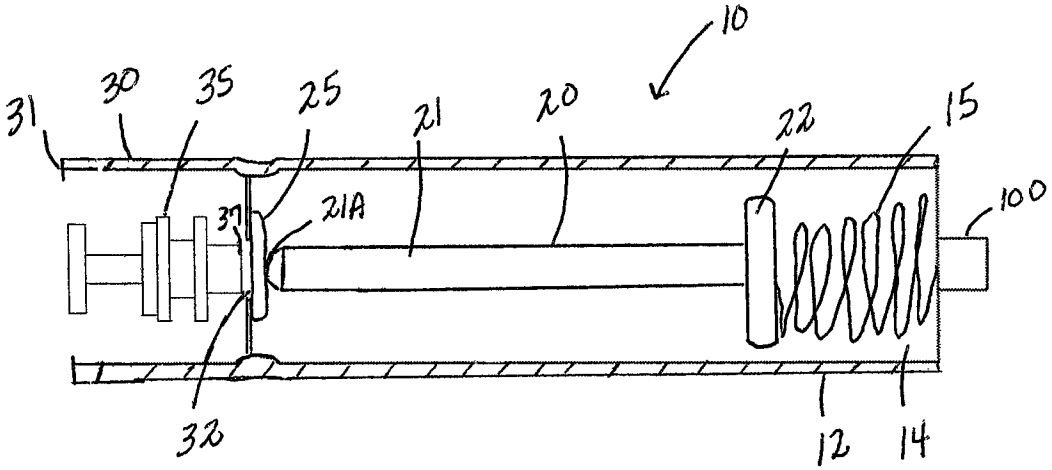
FIG. 3 is a side, sectional view of the water activated buoyancy device of FIG. 1, where the tension mechanism is in a compressed state.

The present invention is now exemplified by a particular embodiment which is illustrated in the accompanying drawings:

FIGS. 1 and 3 are side, sectional views of the invention disclosed. The idea behind the invention is to provide a device which attaches to a negatively buoyant object. In the event the object is dropped in the water over the side of a boat for example, the device will automatically discharge a floatation member upon immersion in the water, whereupon the floatation member floating on the water surface, identifies the location of the lost object so that the user can retrieve the object from the water.

In the preferred embodiment, the water activated device, designated as numeral 10 in the drawings, generally includes a lower casing 12 with a cavity 14 into which a spring 15 is received, followed by a plunger 20 and a bobbin 25. The bobbin 25 is water soluble, such that once water enters the device and contacts the bobbin 25, the bobbin begins to disintegrate. The plunger 20 includes a rod portion 21 and a head 22. The lower casing 12 attaches to an upper casing 30 which houses the floatation member 35 (FIG. 3). The upper casing 30 is open at end 31 and includes a central aperture 32 at the opposite end, the central aperture 32 sized to allow the rod portion 21 of the plunger 20 to pass. On one end of the floatation member 35 defines a flat surface 37. In application the bobbin 25 is sandwiched between the surface 37 and an end 21A of the plunger 20 such that the plunger 20 is contained within the lower casing 12.

As described, the plunger 20 is disposed in the cavity 14 of the lower casing 12 and movable along an axis 50 between a first position, where the spring 15 is in a compressed state (shown in FIG. 3), and a second position, where the spring 15 is relaxed (shown in FIG. 1). As illustrated, the axis 50 is oriented substantially parallel to the length of the lower casing 12. The plunger 20 is held in the first position through the bobbin disposed between the plunger 20 and the flat surface 37 of the floatation member 35.

The bobbin is the water sensitive trigger: when the water comes in contact with the bobbin, the bobbin starts to disintegrate losing its structural integrity and allowing force to enable the tension mechanism 15, pushing the rod portion 21 of the plunger 20 into its second position and forcing the end 21A against the surface 37 of the floatation member 35 which discharges the floatation member from the upper casing 30. Once the floatation member 35 is discharged as described, the floatation member 35, floats to the water surface.

Figure 2:
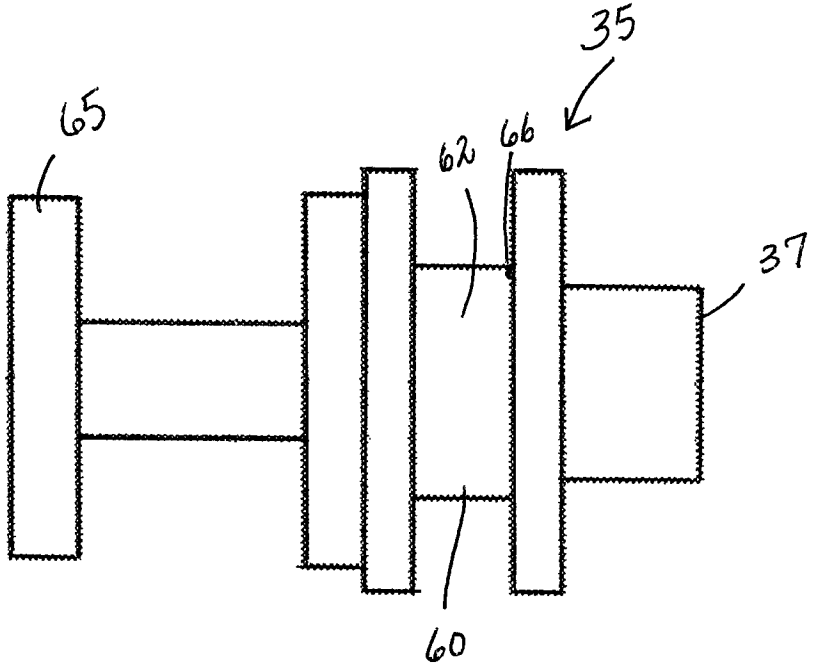
FIG. 2 is a side view of the floatation member of the water activated buoyancy device illustrated in FIG. 1.

Referring to FIG. 2, the floatation member 35 further defines a line holding dispensing spool 60. The spool 60 is generally hollow and cylindrical and includes a portion of 65 constructed of very buoyant material. The spool 60 is further provided with a line receiving portion 62 around which the line (not shown) may be wound. The spool 60 may further include a line holding notch 66 which provides holding means to permit the line to be held while it is wrapped around the receiving portion 62 such that one end of the line is attached to the spool 60 and the opposite end of the line is attached to the device 10.

In operation, the water activated device 10 is appropriately attached 100 to the negatively buoyant object. The negatively buoyant object, such as a bow or firearm, may become displaced from the sportsman's hands, and in the event the object is lost over the side of a boat or the like, and dropped in the water, the water activated buoyancy device 10 will activate when the water comes in contact with the bobbin 25. When the water comes in contact with the bobbin 25, as described, the bobbin 25 starts to dissolve losing its structural integrity allowing the tension mechanism 15 to push the plunger 20 into its second position, forcing the end 21A of the plunger 20 against the surface 37 of the floatation member 35 which discharges the floatation member from the upper casing 20. Once the floatation member 35 is discharged, as the object sinks, the line unwinds allowing the floatation member 35 to float to the water surface. As described, the line is a continued connection between the floatation member 35 and the device 10 attached to the negatively buoyant object. As such, once the object is lost over the side of a boat, sinking to an uncertain depth, the sportsman locates the floatation member 35 floating on the water surface and manually pulls in the line retrieving the object.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the invention. Thus the scope of the invention should be determined by the appended claims in the formal application and their legal equivalence, rather than by these examples given.

I claim:

1. A water activated device comprising:

a body including a lower casing attached to an upper casing;

said lower casing defining a cavity, a tension mechanism in said cavity, and a plunger and a bobbin;

said upper casing for housing a floatation member, wherein said upper casing includes a central aperture that is in fluid communication with said lower casing and sized to allow the plunger to pass, and further includes an open end opposite said central aperture sized to allow said floatation member to discharge;

wherein said bobbin is disposed in said lower casing and sandwiched between the floatation member and the plunger; and, wherein said floatation member defines a line holding dispensing spool that includes a line receiving portion around which a line is wound such that one end of the line is attached to the line holding dispensing spool and the opposite end of the line is attached to said body.

2. The device as recited in claim 1, wherein said floatation member comprising of a buoyant material.

3. The device as recited in claim 1, wherein said bobbin is water-soluble.

4. The device as recited in claim 3, wherein said bobbin is in communication with an end of said plunger and a flat surface of said floatation member.

5. The device as recited in claim 1, wherein said tension mechanism is a spring.

6. The device as recited in claim 5, wherein said tension mechanism is movable on an axis between a first position and a second position.

7. The device as recited in claim 6, wherein said axis is oriented substantially parallel to a length of said lower casing.

8. The device as recited in claim 1, wherein said spool includes a holding means to permit the line to be held while it is wrapped around the line receiving portion.

9. A water activated device comprising:

a body comprising a lower portion and an upper portion;

said lower portion defining a cavity into which a tension mechanism is received, followed by a plunger and a water soluble bobbin;

said upper portion housing a floatation member and includes a central aperture that is in fluid communication with said lower portion and sized to allow the plunger to pass, and further includes an open end opposite said central aperture sized to allow said floatation member to discharge such that when water comes in contact with said bobbin it loses its structural integrity allowing the tension mechanism to push the plunger through said central aperture and against said floatation member causing the floatation member to discharge from said upper portion; and, wherein said floatation member defines a line holding dispensing spool that includes a line receiving portion around which a line is wound such that one end of the line is attached to the line holding dispensing spool and the opposite end of the line is attached to said body.

10. The device as recited in claim 9, wherein said floatation member comprising of a buoyant material.

11. The device as recited in claim 9, wherein said tension mechanism is a spring.

12. The device as recited in claim 11, wherein said tension mechanism is movable on an axis between a first position and a second position.

13. The device as recited in claim 12, wherein said axis is oriented substantially parallel to a length of said lower casing.

14. The device as recited in claim 9, wherein said bobbin is in communication with an end of said plunger and a flat surface of said floatation member.

15. The device as recited in claim 9, wherein said spool includes a holding means to permit the line to be held while it is wrapped around the line receiving portion.

* * * * *